US008640776B2

(12) United States Patent
Tveiten et al.

(10) Patent No.: US 8,640,776 B2
(45) Date of Patent: Feb. 4, 2014

(54) FLUID INJECTION DEVICE

(75) Inventors: Magnar Tveiten, Sandnes (NO); Øyvind Stokka, Sandnes (NO); Erling Kleppa, Jorpeland (NO); Tom Norland, Hommersåk (NO)

(73) Assignee: Petroleum Technology Company AS, Stavenger (NO)

( * ) Notice: Subject to any disclaimer, the term of this patent is extended or adjusted under 35 U.S.C. 154(b) by 0 days.

(21) Appl. No.: 13/480,502

(22) Filed: May 25, 2012

(65) Prior Publication Data

US 2013/0133896 A1 May 30, 2013

Related U.S. Application Data

(62) Division of application No. 12/278,154, filed as application No. PCT/NO2007/000039 on Feb. 7, 2007, now Pat. No. 8,186,440.

(30) Foreign Application Priority Data

Feb. 7, 2006 (NO) ..... 20060610

(51) Int. Cl.
*E21B 34/04* (2006.01)
*E21B 34/08* (2006.01)

(52) U.S. Cl.
USPC ..... 166/344; 166/321; 166/374; 166/90.1; 137/538

(58) Field of Classification Search
USPC ..... 166/368, 326, 339, 344, 268, 373, 374, 166/386, 321, 86.1, 86.3, 80.1, 95.1, 90.1; 137/155, 538, 533.21, 533.31; 251/73, 251/12
See application file for complete search history.

(56) References Cited

U.S. PATENT DOCUMENTS

| | | | | | |
|---|---|---|---|---|---|
| 2,846,014 | A | * | 8/1958 | Daffin et al. | 166/102 |
| 2,921,601 | A | * | 1/1960 | Fisher, Jr. | 137/496 |
| 3,011,511 | A | * | 12/1961 | Canalizo | 137/155 |
| 3,070,119 | A | * | 12/1962 | Raulins | 137/460 |
| 3,100,452 | A | * | 8/1963 | Grimmer et al. | 417/109 |
| 3,160,113 | A | * | 12/1964 | Meyers | 417/112 |
| 3,398,760 | A | * | 8/1968 | Boyd et al. | 137/155 |
| 3,411,584 | A | * | 11/1968 | Sizer et al. | 166/72 |
| 3,523,744 | A | * | 8/1970 | Holladay, Jr. | 417/115 |
| 3,552,490 | A | * | 1/1971 | Dollison | 166/320 |
| 3,595,315 | A | * | 7/1971 | Alley | 166/326 |
| 3,603,394 | A | * | 9/1971 | Raulins | 166/325 |
| 3,752,183 | A | * | 8/1973 | Griswold | 137/504 |
| 3,973,586 | A | * | 8/1976 | Hill et al. | 137/460 |
| 3,973,587 | A | * | 8/1976 | Cochran | 137/496 |
| 4,067,350 | A | * | 1/1978 | Raggio | 137/155 |
| 4,072,166 | A | * | 2/1978 | Tiraspolsky et al. | 137/496 |
| 4,398,555 | A | * | 8/1983 | Taylor | 137/155 |

(Continued)

*Primary Examiner* — Matthew Buck
(74) *Attorney, Agent, or Firm* — Christian D. Abel

(57) ABSTRACT

The present invention regards a device designed for injection of fluids in a well bore, typically an offshore well bore for petroleum production and gas injection/gas lift system for fluid injection. The device comprises a outer hollow housing (1) with an internal body (2) moveable within the outer housing (1) with an internal bore (3) which in a first closed position is closed with a metal to metal seal system between the outer housing (1) and the internal body (2), which internal body (2) is operated by pressure differential across the internal body (2), where the internal body (2) is designed with slots (4) forming outlets of the internal bore (3) which in an open position of the device is positioned outside of the outer housing (1).

15 Claims, 2 Drawing Sheets

(56) References Cited

U.S. PATENT DOCUMENTS

| | | | | | |
|---|---|---|---|---|---|
| 4,462,465 | A * | 7/1984 | Strickland | 166/117.5 |
| 4,487,221 | A * | 12/1984 | Zwart | 137/508 |
| 4,494,608 | A * | 1/1985 | Williams et al. | 166/317 |
| 4,565,215 | A * | 1/1986 | Cummings et al. | 137/538 |
| 5,004,007 | A * | 4/1991 | Johnson et al. | 137/501 |
| 5,009,393 | A * | 4/1991 | Massey | 251/207 |
| 5,105,852 | A * | 4/1992 | Wagner | 137/625.33 |
| 5,215,254 | A * | 6/1993 | Haruch | 239/107 |
| 5,479,988 | A * | 1/1996 | Appleton | 166/325 |
| 5,779,148 | A * | 7/1998 | Saarem et al. | 239/104 |
| 5,794,917 | A * | 8/1998 | Sahm et al. | 251/176 |
| 6,148,843 | A * | 11/2000 | Pringle | 137/155 |
| 6,196,259 | B1 * | 3/2001 | Weber | 137/504 |
| 6,460,620 | B1 * | 10/2002 | LaFleur | 166/324 |
| 6,631,767 | B2 * | 10/2003 | Pringle et al. | 166/320 |
| 7,814,982 | B2 * | 10/2010 | Moyes | 166/373 |
| 8,181,705 | B2 * | 5/2012 | Tveiten et al. | 166/344 |
| 8,186,440 | B2 * | 5/2012 | Tveiten et al. | 166/344 |
| 2006/0124884 | A1 * | 6/2006 | Dnestrianschii et al. | 251/231 |
| 2007/0215358 | A1 * | 9/2007 | Messick et al. | 166/372 |
| 2009/0025938 | A1 * | 1/2009 | Tveiten et al. | 166/351 |
| 2009/0065215 | A1 * | 3/2009 | Tveiten et al. | 166/368 |
| 2010/0212908 | A1 * | 8/2010 | Stokka et al. | 166/319 |

* cited by examiner

FLUID INJECTION DEVICE

CROSS REFERENCE TO RELATED APPLICATIONS

This is a divisional application of U.S. application Ser. No. 12/278,154, filed 4 Aug. 2008.

FIELD OF THE INVENTION

The present invention regards a device for injection of fluid in a well bore, typically an offshore well bore, typically installed on Christmas trees or wellheads, for petroleum production and gas injection/gas lift system.

BACKGROUND

There are known several different principles of operating a gas injection valve, one of this is based on the venturi principles, for instance described in WO 2004/092537 A1. Another approach is to have a central stem with outer sealing surface and through going flow between an outer housing and the central stem across the sealing surfaces, for instance described in CA 02461485 A1.

After a period of time, known gas lift valves will have a tendency of not working as expected. One problem might be the erosion of the sealing surfaces of the valve device which lead to leakage across the valve seat and reduced performance and a reduced lifetime for the valve devices. This creates a problem for operation of the well with increased down time, maintenance time and an increased safety hazard.

SUMMARY OF THE INVENTION

An aim with the present invention is to minimize and possibly alleviate these problems. It is also an aim to provide a device with a true metal to metal sealing of the device. Metal to metal seal in a preferred embodiment is understood to be a single seal between two metallic surfaces without any secondary seal, soft seal or a combination of such. It is also an aim to provide a device with a reduced erosion rate of the sealing surface. Another aim is to provide a device with an increased flow area compared with similar known valves. There is a further aim to provide a device with minimal flow restrictions and disturbances in the injection flow, giving reduced pressure losses across the device.

These aims are achieved by a device according to the following claims and alternative embodiments are given in the description.

The present invention regards a device designed for injection and stimulation of fluids in a well bore, typically an offshore well bore for petroleum production and gas injection/gas lift system for fluid injection. The device may also be used for chemical injection of other constituents such as well stimulation fluids, cutting injection, water injection etc. This device, which is used to create a one-way seal within a Christmas tree or a wellhead flange outlet, seals off within a dedicated spool piece, which spool piece is made up between the wellhead and a manual gate valve. A hydraulic port in the spool piece allows hydraulic pressure to be routed to the device for its operation.

The device comprises an outer hollow housing with an internal body moveable within the outer housing. According to the invention the internal body comprises an internal bore which in a first closed position is closed with a metal to metal seal system between the outer housing and the internal body. The movement of the internal body may be operated by pressure differential across the internal body. This pressure differential may be a fluid pressure operating on surfaces of the internal body, which surfaces may be exposed to different fluids. These fluids may be well fluids on one or more surfaces for operating the device or injections fluid on one surface and well fluid on another surface or combinations. According to an aspect the pressure differential across the internal body may be assisted by at least one predetermined pressure balanced elastic element to open and close the device.

According to the invention the internal body comprises at least one slot between the bore and the outside of the internal body. These slots in the internal body are leading directly to the outside of the outer housing in an open position of the device, and are positioned within the outer housing in a closed position of the device. The part of the internal body comprising the slots are moved relative the outer housing from a position within the outer housing in a closed state of the valve to a position at least partly outside the housing in an open state of the valve.

According to an aspect of the invention the slots may be longitudinal and distributed on the circumference of the inner body. The distribution may be evenly around the circumference of the internal body. The form of the slot may be even or odd around the circumference of the body. The slots may be longitudinal with a main longitudinal direction mainly parallel with a longitudinal axis of the internal body. The slots may be longitudinal with a main direction at an angle relative to the longitudinal axis of the internal body or form a part spiral shape around a longitudinal axis, or formed with another shape. The slots around the internal body may also be of different shapes, whereof some may be larger than other slots.

According to another aspect the slots in the internal body may be made beveled and angled from an internal surface to an outer surface of the internal body in order to obtain stream line flow.

According to another aspect of the invention the seal system comprises a valve seat in the outer housing and a valve element sealing surface on the internal body. With open position one should in this description understand a position wherein the slots of the internal body are positioned with at least a part outside the outer housing seen in a direction transverse to the longitudinal axis of the device.

According to another aspect of the invention the valve seat and the valve element sealing surface in an open or partially open position are positioned on opposite sides of a slot seen in a longitudinal direction of the device. This gives that the slots forming the flow path of the injection fluid are positioned between the valve seat and the valve element sealing surface in an open position of the device.

According to another aspect of the invention the valve seat may comprise a low pressure guide to obtain optimal guiding sealing engagement as a secondary embodiment.

According to another aspect the internal body comprises a stop surface which in a fully open position of the device is abutting against a corresponding surface in the outer housing.

According to another aspect of the invention the internal body and outer housing may comprise corresponding parts of at least one guiding element predefining a travel between a closed and an open position of the device. In addition or alternatively the internal body may comprise at least one fluid balanced wing(s) or baffle(s) and or added slots in the internal surface of the internal body exposed to the injection fluid to guide the internal body in a predetermined travel between open and closed position of the device. This predefining travel may be linear, rotational and or a combination of this.

According to another aspect of the invention the device further may comprise at least one element for overriding and or controlling the open and or closed position of the device.

According to another aspect of the invention the outer housing may comprise a wiper element positioned to abut against and clean the sealing surface during closing of the device. This is favorable in the case when the injection fluid contains particles prone to be attached to the sealing surfaces.

According to another aspect of the invention the elastic element may comprise a spring element enclosed in a chamber, which chamber in one embodiment may be filled with a fluid separate from both well and injection fluid and which chamber in another embodiment may be in fluid contact with the internal bore of the internal body or the outside of the housing.

According to yet another embodiment the outer housing and or the internal body may comprise several separable elements connected by for instance threaded joints. This gives the possibility to replace for instance the element of the outer housing comprising the valve seat without having to replace the whole housing.

The injection device of the present invention may also be positioned in a hydraulic spool piece in relation to a Christmas tree as mentioned above. The spool piece may be formed as a flange and comprise a main bore, in which main bore the injection device may be positioned. There may also be additional side bores for adding of hydraulic fluid and possible venting. The side bores may be adapted to be in communication with at least one opening in the outer housing of the injection device, in order to add hydraulic fluid for operation of the device. Such a system will be equipped with additional sealing elements in appropriate places and a skilled person will understand this. The device may also comprise a pretension means to set the device, i.e. the valve to a given position when hydraulic pressure is not present through the opening, for instance a closed position. The pretension device may be an elastic element such as spring or other pretension means.

These features of the invention will provide a device where the flow path of the injection fluid is substantially less tortuous than other known gas injection valves due to the more direct flow through the bore in the internal body and directly out through the slots of the valve. This also gives less pressure losses across the valve. The present invention is also a device with few elements, compared with the majority of other known injection valves. This gives a more reliable device as well. The present invention also has a relatively large flow area through the device; compared with the majority of other known injection valve of similar size.

BRIEF DESCRIPTION OF THE DRAWINGS

Following there will be given a non-limiting description of embodiments of the invention with reference to the accompanying drawings, where

In FIG. 1 there is shown a first embodiment of a device according to the invention. A skilled person will understand how to position the valve device within a well stream and this is therefore not described in this application.

DETAILED DESCRIPTION

Figure 1:
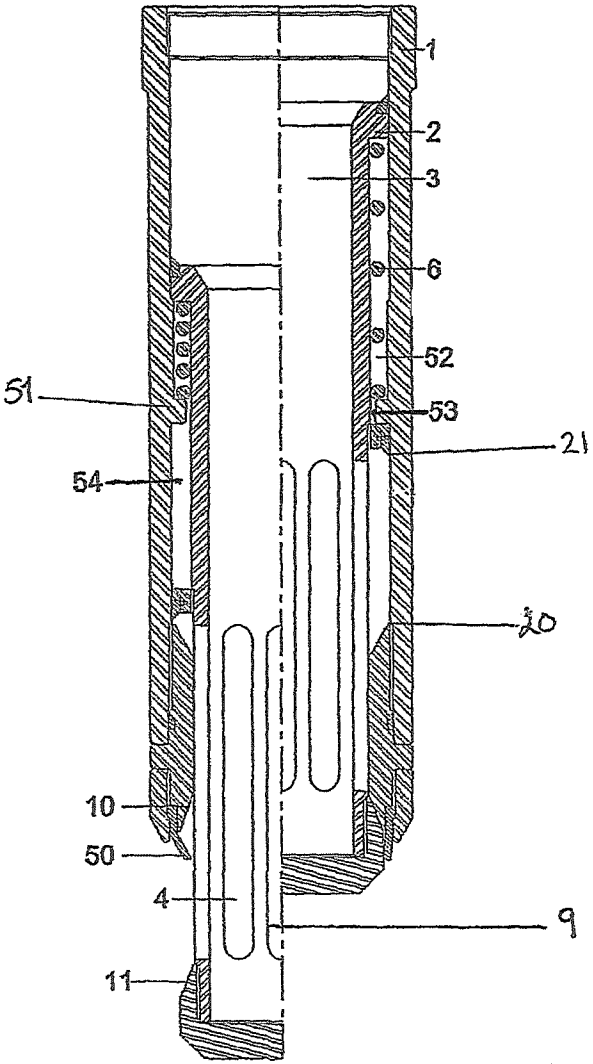
FIG. 1 shows a cross section of an embodiment of the present invention in an open and closed position of the device.

In FIG. 1 the device comprises an outer housing 1, which is formed from several elements, with an internal body 2 movable within the outer housing 1 between two positions, an open position shown to the left in the figure and a closed position shown in the right half of the figure. The internal body 2 is movable in the longitudinal direction of the internal body 2 and outer housing 1. The outer housing 1 comprises an injection fluid inlet at one end of the outer housing 1 connected to a source of injection fluid (not shown). The injection fluid is transferred through an internal void of the outer housing 1 to an internal bore 3 of the internal body 2. The bore 3 stretches in the longitudinal direction of the internal body 2. The injection fluid will thereafter in an open position of the valve flow through slots 4 leading from the internal bore 3 to the outside of the internal body 2, and the outside of the outer housing 1. This gives a flow pattern in an open position of the valve for the injection fluid which is with a minimum amount of bends, obstructions and or diametrical changes, giving minimal pressure losses across the valve. To improve the flow pattern a surface 9 of the slots 4 between an internal to an external side of the internal body 2 may be angled with angles other than 90 degrees with a longitudinal axis of the device. The surfaces 9 may also be formed with varying angles dependent on where around the slot 4, the part of the surfaces 9 it is.

The valve shown also comprises an elastic element 6 arranged between a shoulder of the outer housing 1 and a shoulder of the internal body 2, biasing the internal body 2 to a closed position of the valve. When the pressure differential across the internal body 2 reaches a set limit this pressure difference will move the internal body 2 against the elastic element to an open position, where also a stop surface 21 of the internal body 1 may be abutting a stop surface 20 of the outer housing 2, or the pressure from the elastic element will move the internal body 2 to a closed position of the valve.

The internal body 2 comprises an annular, valve element sealing surface 11, with a mainly conical shaped surface. This surface 11 is arranged close to an end of the internal body 2 with the end of the conical shaped surface 11 with the larger diameter, furthest away from the slots 4 of the internal body 2. The slots 4 are arranged close to an end of the internal body 2, and the surface 11 closer to the same end of the internal body 2. The sealing surface 11 of the internal body cooperates with a valve seat 10 arranged in the outer housing 1. The valve seat 10 in the outer housing 1 is arranged on the relative speaking other side of the slot 4, when these are in an open position, compared with the sealing surface 11 of the internal body 2, seen in a longitudinal direction of the device. In a closed position, the internal body 2 is moved relative to the outer housing 1 so that the sealing surface 11 is abutting the valve seat 10, giving a sealed, metal to metal seal for the valve. In this closed position the slots 4 of the internal body 2 will be positioned within the valve device. In this embodiment there is arranged a wiper element 50 at the end of the outer housing. This wiper element will when the valve is closing abut against the valve element sealing surface 11, scraping off any attached particles and other foreign element from the sealing surface 11 before it comes in contact with the valve seat 10 for sealing engagement between the surface 11 and the valve seat 10. The elastic element 6, in the form of a spring is arranged in a closed chamber 52, with an opening 53 between this chamber 52 and a second chamber 54 which works as a storage chamber for fluid within chamber 52 when the elastic element 6 becomes compressed. The two chambers 52, 54 are separated from each other by an internal flange 51 of the outer housing 1, giving only a small passage 53 for the transferal of fluid between the chamber 52, 54, thereby also regulating the movement of the inner body 2 relative the outer body 1. The form of the closed chambers 52, 54 around the elastic element, keeps any foreign particles which may affect the performance of the elastic element 6, away from the elastic element 6.

Figure 2:
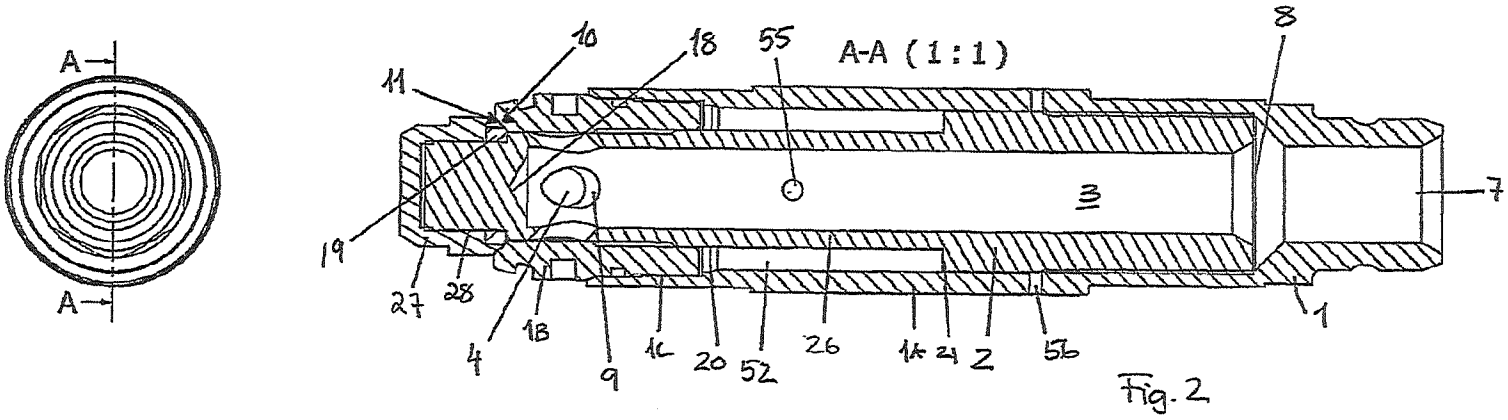
FIG. 2 shows a cross section of a second embodiment in a closed position of the device.

In FIG. 2 there is shown a second embodiment of the device comprising an outer housing 1 and an internal body 2 movable within the outer housing 1. The outer housing 1 has an inlet 7 for the fluid entering the valve device, and there may in relation to this inlet also be positioned an orifice 8 to regulate the flow through the device, to for instance give the flow a rotating flow pattern. The outer housing 1 comprises a first part 1A and a second part 1B comprising the valve seat surface 10, which two parts 1A, 1B are connected by a threaded connection 1C. The outer housings second part 1B also comprises a stop surface 20. There are also an aerating opening 56 in the outer housing to prevent any trapped fluid between the internal body 2 and the outer housing 1 from stopping the movement between the internal body 2 and the outer housing 1, this opening 56 may also be connected to a source of hydraulic fluid to operate the device between a closed and an open position. In such a configuration there will be appropriate sealing elements arranged between the internal body 2 and the outer housing 1 and a skilled person will understand how this is done.

The internal body 2 comprises in this embodiment a first part 26 and a second part 27, connected by a threaded connection 28. The first part 26 comprises an internal bore 3 connected with the inlet 7 of the outer housing 1, so that the inlet 7 leads directly to the internal bore 3 without any deviation of the flow of fluid through the device other than possibly passing an orifice 8, to give the flow of fluid through the valve device a most direct route with reduced pressure loss. The first part 26 further comprises an aerating opening 55, connecting the internal bore 3 with an chamber 52 formed between the outer housing and the internal body and the stop surface 30 of the outer housing and a stop surface 21 formed in the outer wall of the internal body, limiting the movement of the internal body 2 relative the outer housing in the open state of the valve. The first part 26 of the internal body 2 comprises also slots 4 running from the internal bore and radially outwards through the wall of the internal body 2. The slots 4 in this embodiment has a more elliptic form and the slot surface 9 formed in the wall of the internal body are formed at an angle different then 90 degrees with a longitudinal axis of the internal body, thereby directing the flow of fluid out of the device. The second part 27 of the internal body 2 comprises the sealing surface 11 for abutment against the valve seat 10 arranged on the outer housing 1. Looking at the internal body in a radial direction gives that the sealing surface 11 forms an end of the second part 27 adjacent a section of the first part 26 of the internal body, and in between there is positioned additional sealing element 19, kept in place by the connection of the first 26 and second part 27 of the internal body 2. This sealing element 19 will also form a part of the sealing surface as it in a closed position of the valve device partly will abut the valve seat 10 of the outer housing 1. The internal end surface 18 of the internal bore 3 in the internal body 2, close to the slots 4 is in this embodiment countersunk. In the embodiment in FIG. 1 the similar surface is a flat surface. This internal end surface will form part of a pressure surface regulating the position of the valve device as a response to a pressure differential across the valve device.

As an alternative, one could also use the device to vent gas back out of the casing annulus. This can be done when the device is in an open position, where elements for overriding and or controlling the device are used to hold it in the open position.

The invention has now been explained with an embodiment. Only elements related to the invention is described and a skilled person will understand that an outer housing or internal body may be formed in one unit or be comprised of several connected elements, and that the inlets have to be connected to a source of the fluid to be injected, that there should be appropriate attachment devices for attaching the valve within a process fluid stream and inside a hydraulic flange, and that there of course will be arranged for instance sealing element between several elements as a standard. The skilled person will also understand that one may make several alterations and modifications to the described and shown embodiment that are within the scope of the invention as defined in the following claims.

The invention claimed is:

1. Device for injection and stimulation of fluids in a process fluid, typically an offshore well bore, typically installed on Christmas trees or wellheads, for petroleum production and gas injection/gas lift system where the device comprises an outer hollow housing (1) and an internal body (2) moveable within the outer housing (1), comprising an internal bore (3), which in a closed position is closed with a seal system between the outer housing (1) and the internal body (2), the internal body (2) being operated by pressure differential across the internal body (2), wherein the outer housing (1) comprises a stop surface (20) and the internal body (2) comprises a stop surface (21), a chamber (52) being formed between the outer housing (1), the internal body (2) and the stop surfaces (20, 21), where the internal body (2) furthermore comprises at least one slot (4) forming outlets of the internal bore (3), wherein the at least one slot (4) in an open position of the device is positioned at least partly outside the outer housing (1) leading out to a surrounding fluid, and further wherein the outer housing (1) comprises a through going opening (56) for allowing hydraulic fluid to be added to the device for operation of the device between the open and the closed position.

2. Device according to claim 1, wherein the pressure differential across the internal body (2) is assisted by at least one predetermined pressure balanced elastic element to open and close the device.

3. Device according to claim 1, wherein the at least one slot (4) comprises a plurality of slots (4) which are longitudinal and distributed on the circumference of the inner body (2).

4. Device according to claim 3, wherein the slots in the internal body (2) are beveled and angled from an internal surface to an outer surface of the internal body (2) in order to obtain a predetermined stream line flow.

5. Device according to claim 3, wherein the longitudinal slots in the internal body (2) are parallel to a longitudinal direction of the device or twisted or bend around the longitudinal axis.

6. Device according to claim 1, wherein the seal system comprises a valve seat (10) in the outer housing (1) and a valve element sealing surface (11) on the internal body (2).

7. Device according to claim 6, wherein the valve seat (10) and the valve element sealing surface (11) in an open or partially open position are positioned on opposite sides of the at least one slot (4) seen in a longitudinal direction of the device.

8. Device according to claim 1, wherein the device further comprises elements for overriding and or controlling the open and or closed position of the device.

9. Device according to claim 6, wherein the outer housing (1) comprises a wiper element (50) positioned to abut against and clean the sealing surface (11) during closing of the device.

10. Device according to claim 2, wherein the elastic element (6) comprises a spring element enclosed in the chamber (52), which chamber is filled with a fluid separate from both well and injection fluid.

11. Device according to claim 6, wherein the valve element sealing surface (11) in an open position of the device is positioned outside the outer end of the outer housing (1).

12. Device according to claim 1, wherein the outer housing (1) comprises a first part (1A) and a second part (1B), which first and second parts (1A, 1B) are connected by a threaded connection (1C).

13. Device according to claim 1, wherein the outer housing (1) comprises an inlet (7).

14. Device according to claim 1, wherein the internal body (2) comprises a first part (26) and a second part (27), which first and second parts (26, 27) are connected by a threaded connection (28).

15. Device according to claim 1, wherein the internal body (2) comprises an orifice (8).

* * * * *